United States Patent [19]

Hamey et al.

[11] Patent Number: 5,064,351

[45] Date of Patent: Nov. 12, 1991

[54] VARIABLE DISPLACEMENT PUMPS

[75] Inventors: Peter M. Hamey, Emsworth; Ronald B. Walters, Wembley, both of England

[73] Assignee: Vickers Systems Limited, England

[21] Appl. No.: 428,117

[22] Filed: Oct. 27, 1989

[30] Foreign Application Priority Data

Nov. 2, 1988 [GB] United Kingdom ..... 8825614
Mar. 30, 1989 [GB] United Kingdom ..... 8907145

[51] Int. Cl.[5] ..... F04B 1/26
[52] U.S. Cl. ..... 417/222 R
[58] Field of Search ..... 417/222, 218, 221

[56] References Cited

U.S. PATENT DOCUMENTS

| | | | |
|---|---|---|---|
| 3,230,699 | 1/1966 | Hann et al. | 417/222 |
| 3,416,452 | 12/1968 | Misulis | 417/222 |
| 3,563,675 | 2/1971 | Straznickas | 417/222 |
| 3,785,754 | 1/1974 | Miller | 417/222 |
| 4,398,869 | 8/1983 | Kirkham et al. | 427/218 |
| 4,474,104 | 10/1984 | Creffield | 417/221 |
| 4,578,019 | 3/1986 | Safarik | 416/1 |
| 4,600,364 | 7/1986 | Nakatani et al. | 417/218 |
| 4,718,825 | 1/1988 | Avery | 417/218 |

*Primary Examiner*—Richard A. Bertsch
*Assistant Examiner*—David W. Scheuermann
*Attorney, Agent, or Firm*—Barnes, Kisselle, Raisch, Choate, Whittemore & Hulbert

[57] ABSTRACT

A rotary, variable-displacement hydraulic pump (1) in use driven by a prime mover (4), the pump (1) comprising control means (5) for varying the displacement of the pump and means (17) responsive to a signal related to the rotational speed of the pump and operable to override the control means so as, in use, to prevent stalling of the prime mover (4) within a predetermined operational range of the prime mover.

34 Claims, 7 Drawing Sheets

$$K = \frac{K_V \; S_1}{A \; S_2} \left[ sec^{-1} \right]$$

$$K = \frac{K_V \quad C_O \quad K_F \quad \alpha_F \quad \omega}{S_2 \quad A \quad \theta_O}$$

$P_1 \times Q_1 = P_2 \times Q_2 = P_3 \times Q_3$

VARIABLE DISPLACEMENT PUMPS

BACKGROUND OF THE INVENTION

1. Field of the Invention

This invention relates to variable displacement pumps and more particularly, to such pumps which are of a rotary nature. The invention has been conceived in connection with an emergency hydraulic power supply for aircraft and will, in the main, be discussed in relation thereto but the invention is not restricted to such an application.

2. Description of the Prior Art

In aircraft, hydraulic power is used to move the control ailerons, etc., and in most types of aircraft, it is a requirement that an emergency source of hydraulic power be provided which can be used in the event of a failure of the main hydraulic power system. To this end, it is known to employ a prime mover, such as a ram air turbine, for a variable displacement hydraulic pump, the prime mover powering the hydraulic pump in order to provide emergency hydraulic power for the control ailerons, etc. However, with a prime mover which is dependent upon the airspeed of the aircraft, then as the aircraft loses airspeed in an emergency situation, the prime mover loses power and the alternative hydraulic power supply can be lost at a relatively early stage because with a variable displacement pump, a pressure compensator is normally provided which ensures that the pump delivers hydraulic fluid at the flow rate demanded by the system and at a predetermined pressure. Accordingly, if the outlet pressure of the pump falls due to decreasing airspeed, then the pump will automatically try to increase that pressure by increasing the stroke of the pump, resulting in increased pump demanded power leading to stalling of the prime mover. Clearly, this is not acceptable with an emergency hydraulic supply and it is the principal object of the present invention to obviate this problem.

SUMMARY OF THE INVENTION

According to the present invention, there is provided a rotary, variable-displacement hydraulic pump in use driven by a prime mover, the pump comprising control means for varying the displacement of the pump and means responsive to a signal related to the rotational speed of the pump and operable to override the control means so as, in use, to prevent stalling of the prime mover within a predetermined operational range of the prime mover.

In the application of the present invention to aircraft, it is desirable that the variable displacement pump is entirely of a hydro-mechanical nature because most aviation authorities insist on at least duplication of any electrical or electronic control for safety purposes, this being a requirement primarily in connection with civil aviation. Accordingly, if electrical or electronic control can be avoided, then a simpler and less expensive system can be adopted. Accordingly, the signal related to the rotational speed of the pump is may be a hydraulic pressure or force signal as opposed to an electrical signal although the latter can be employed in aerospace applications, if the required redundancy is acceptable, or in other applications where redundancy of electrical systems is not a requirement.

The variable displacement pump is conveniently in the form of a swash pump with the override means operable physically to adjust the swash plate angle, i.e. the stroke of the pump. The override means may be in the form of a control valve responsive to the signal related to the rotational speed of the pump and operable to apply pump outlet pressure to the displacement means of the pump to de-stroke the pump when the rotational speed of the pump decreases. The control valve may be responsive to swash plate angle or to flow in order to control the stroke of the pump with decreasing pump speed.

In a preferred embodiment, a speed sensor is provided in association with the override means so as to maintain the overall system at a substantially constant speed by changing the stroke or displacement of the pump to match the off-take power to available prime mover power. With this arrangement, the override means could be programmed, i.e. the governed speed can be programmed or adjusted and this could be achieved mechanically, hydraulically, electrically or a combination thereof.

In the application of the preferred embodiment to aircraft, the prime mover may be in the form of a ram air turbine which itself may have a speed governor which is operable to maintain a substantially constant turbine rotational speed (for example 5250 rpm) by varying blade pitch angle at airspeeds of above 171 KTS, for example. In this regime, the turbine and the control of the variable-displacement pump operate normally. In another second regime of airspeeds (hereinafter referred to as the "third regine") between 155 and 171 KTS, for example, the turbine speed drops below the governed speed, whereby the turbine speed governor is no longer effective, and the turbine blades are at a constant (fine) pitch. The speed governor associated with the override means is still not operative. However, in yet another regime of airspeeds (hereinafter referred to as the "second regime") between 125 and 155 KTS, for example, the override speed governor is operative and maintains a speed of 3800 rpm, for example. During this second regime, output torque from, for example, the ram air turbine decreases with decreasing air speed and because the speed is kept constant, output power will decrease proportionately. The displacement control provides a power match between the prime mover and the pump limiting the maximum power that can be demanded by the pump to that available from the prime mover. For any given air speed in this second regime between 125 and 155 KTS, for example, constant power will be available from the prime mover which can be used by the pump, to satisfy the system demands, in combinations of flow and pressure which equate to constant power. This provides substantially constant horsepower cut-off characteristics to the pump which at relatively low flow demands operates still as a pressure-compensated pump but at larger demands operates at a substantially constant horsepower, whereby pump pressure decreases as flow increases.

BRIEF DESCRIPTION OF THE DRAWINGS

Rotary, variable displacement hydraulic pumps in accordance with the present invention will now be described in greater detail, by way of example, with reference to the accompanying drawings, in which.

DESCRIPTION OF THE PREFERRED EMBODIMENTS

Figure 1:
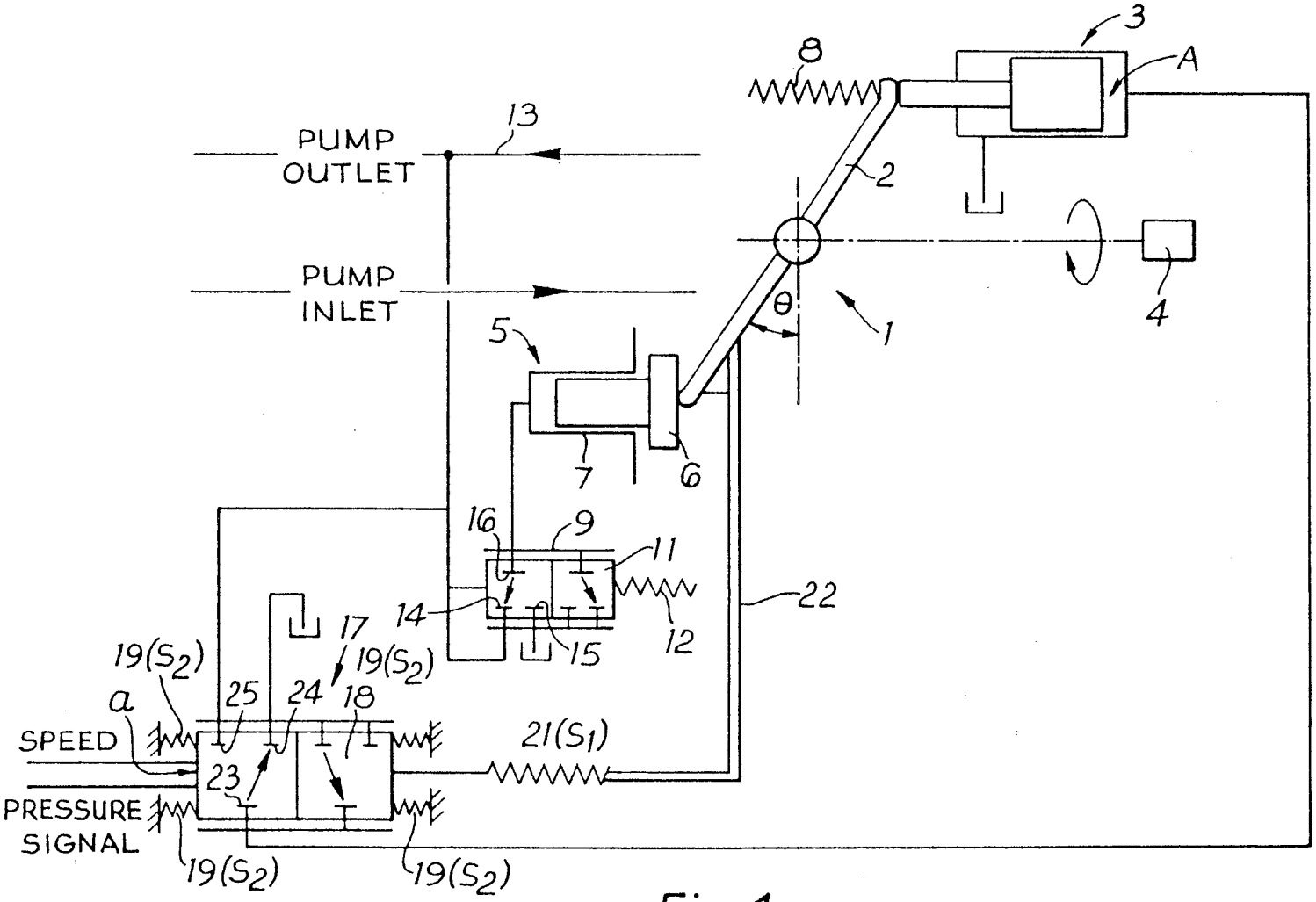
FIG. 1 is a schematic diagram of a first embodiment of the present invention.

Referring first to FIG. 1 of the drawings, the first embodiment of the present invention is in the form of an auxiliary hydraulic supply for an aircraft, hydraulic pressure being provided by a rotary, variable-displacement pump in the form of a swash pump indicated generally at 1 and being represented only by a swash plate 2 and a swash plate angle control piston and cylinder arrangement 3. The rotary piston block and pistons of the pump are not shown. The pump is driven by a prime mover in the form of a ram air turbine indicated by block 4 and the pump is fitted with a conventional pressure compensator which is operable to ensure that the pressure of the hydraulic fluid provided by the pump is maintained relatively constant. The pressure compensator is indicated at 5 and comprises a piston 6 operating within a cylinder 7, the piston being in contact with the swash plate 2, this contact being maintained by a spring 8. A control valve 9 is associated with the piston and cylinder 6, 7, the valve 9 being in the form of a proportional control valve having a spool 11 urged in one direction by a return spring 12. The outlet pressure of the pump 1 on line 13 is applied to the end of the spool 11 opposite to that on which the return spring 12 acts and also to an inlet port 14. A second port 15 is connected to tank and the control port 16 is connected to the cylinder 7.

In normal operation, the pressure compensator 5 operates to maintain the pump outlet pressure substantially constant in the following manner. If the pump outlet pressure rises, then the spool 11 of the control valve 9 is moved to the right, as seen in FIG. 1 of the drawings, and assumes the position illustrated in which the pump outlet pressure is connected to the control port 16 and hence to the cylinder 7, whereby the piston 6 is moved to the right and thus reduces the angle $\theta$ of the swash plate 2. If the pump outlet pressure on line 13 decreases, then the spool 11 of the control valve 9 moves to the left, whereby the control port 16 is connected to the tank port 15, thus allowing the piston 6 to retract within the cylinder 7 and hence allow the swash plate angle $\theta$ to increase under the action of the spring 8.

This normal operation of the pump is entirely adequate when the input power from the prime mover 4 is sufficient. However, in the case of an aircraft, if the airspeed decreases, then the rotational speed of the ram air turbine 4 will decrease, and hence the rotational speed of the swash pump 1 will also decrease and, as a consequence, output flow from the pump will decrease. With the latter decrease, there will follow a decrease in hydraulic power delivered by the pump and thus the compensator will call for more power by increasing pump displacement but as this will increase the power required to drive the pump, then the stall condition of the prime mover 4 will soon be reached. Clearly, if the alternative hydraulic system provided by the pump 1 and prime mover 4 is required to meet an emergency situation, namely the failure of the main hydraulic supply to the aircraft, then a premature stall condition of the prime mover 4 is unacceptable. In accordance with the present invention, an override system is provided so as to prevent stalling of the prime mover and thus maintain a supply of pressure fluid for operating the aircraft controls, albeit at a reduced rate.

Figure 2:
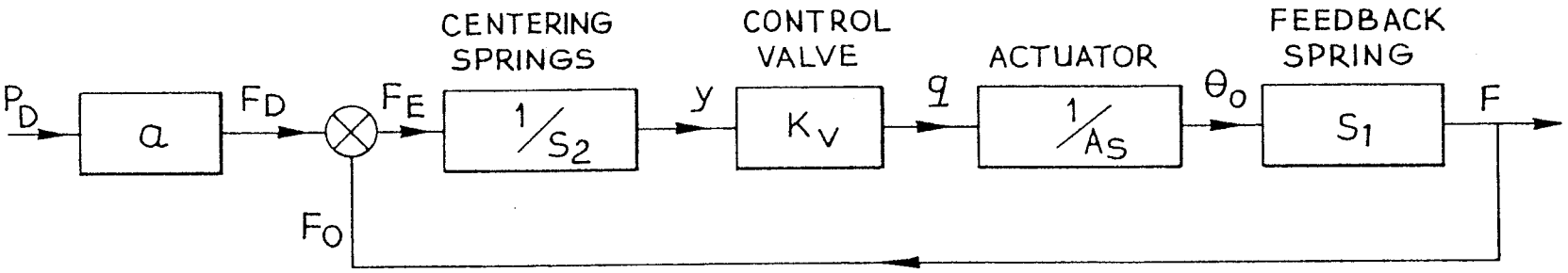
FIG. 2 is a block diagram representing the embodiment of FIG. 1.

The override means in the embodiment of FIG. 1 comprises a proportional control valve 17 having a spool 18 which is centered, in the null condition by conventional centering springs 19 which will be referred to in connection with FIG. 2 of the drawings as springs S2. A feedback spring 21 (which will be referred to as S1) acts between one end of the spool 18 and the swash plate 2 via an extension diagrammatically represented at 22. The other end of the spool 18 has applied to it a pressure signal which is derived from, and is proportional to, the speed of the hydraulic pump 1. A control port 23 of the valve 17 is connected to the cylinder of the displacement piston 3 at the larger diameter end thereof which will be referred to as area A. The control port 23 is connected either to a tank port 24 or to a port 25 connected to the outlet line 13 of the pump 1.

The operation of the override means is as follows. If the rotational speed of the pump is at the normal (high) level then the pressure signal related thereto will be relatively high and will override the action of the feedback spring 21 (SI) and place the spool 18 of the valve 17 in the position shown in FIG. 1 of the drawings. Thus, the area A of the displacement cylinder 3 will be connected to tank and thus allow the pressure compensator 5 to operate in the normal manner as discussed above. However, if the rotational speed of the pump 1 decreases, giving a proportionate decrease in signal pressure on area A due to a decrease in the rotational speed of the ram air turbine 4, then the feedback spring 21 (S1) will move the spool 18 of the valve 17 to the left (as seen in FIG. 1) with a result that the control port 23 will be connected to the outlet line 13 of the pump, this outlet pressure thus acting on the end of the swash plate angle control cylinder 3 (area A) so as to extend the piston therefrom and thus act on the swash plate 2 such as to decrease the angle $\theta$ thereof, i.e. to de-stroke the pump 1. This action of the displacement piston 3 is against the action of the spring 8. This action of the displacement piston 3 against the swash plate return spring 8 reduces the load in the feedback spring (S1) until the force exerted by the spring on the spool 18 is equal to the force exerted on the spool 18 by the signal pressure acting on area a. This action returns the spool 18 to a null position which maintains the pressure on area A such that the control cylinder 3 holds the swash 2 in its new position. Thus, the override system operates to de-stroke the hydraulic pump on the decrease of the rotational speed of the pump and thus prevent stalling of the prime mover 4, at least within a predetermined operating range thereof which is arranged to be the range in which the pump can be maintained operational as a matter of practicality as regards the control of the aircraft flying controls, such as ailerons, and other services. Clearly, if the aircraft airspeed is reduced such that stalling of the ram air turbine 4 cannot be prevented, then the aircraft itself will be at, or close to, a stall condition so that the failure of the alternative hydraulic supply will be of no consequence.

The embodiment of FIG. 1 of the drawings is represented in block form in FIG. 2 from which it will be seen that a demand pressure $P_D$ is applied to the end of the spool 18 indicated as area A which produces a demand force $F_D$ which is applied to a summation device to which is also applied to feedback force $F_O$ from the feedback spring S1 (21). The resulting error force is applied to the inverse rate of the centering springs S2 (19) to provide a displacement y which is applied to the control valve 17 represented as $K_V$ to provide a flow q which in turn is applied to the area A of the swash plate angle control piston and cylinder. This changes the angle $\theta$ of the swash plate 2 and this change in angle is applied to the feedback spring S1 to provide the output force which, as already mentioned, is fed back to the summation means. FIG. 2 illustrates that the equation for the loop gain K provided by the feedback loop of FIG. 1 is as follows:

$$K = \frac{K_V \cdot S_1(\sec^{-1})}{A \cdot S_2}$$

Figure 3:
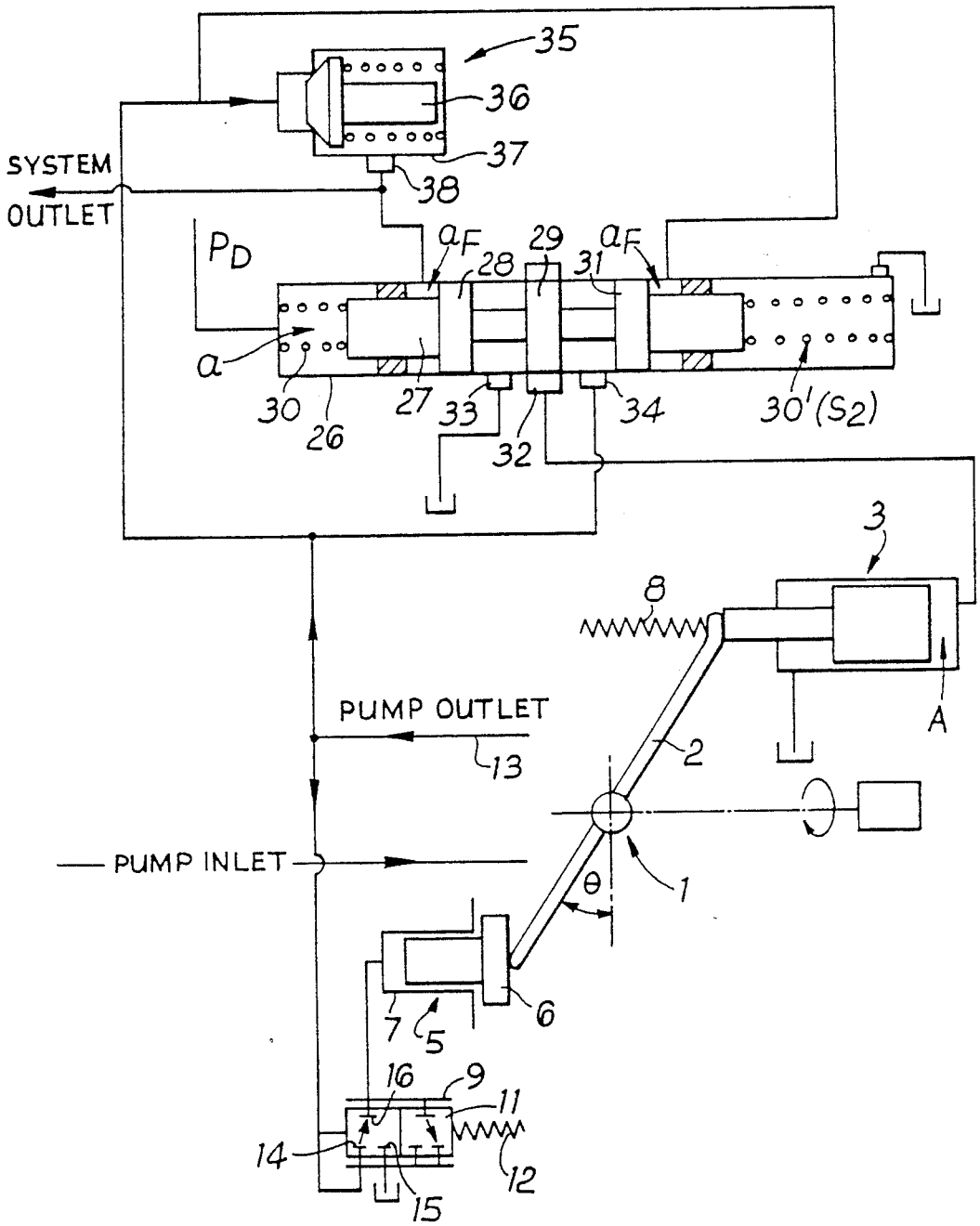
FIG. 3 is a schematic diagram of a second embodiment of the present invention.

Turning now to FIG. 3 of the drawings, this represents an alternative embodiment in which the override means is in the form of a flow feedback loop as opposed to a swash angle feedback loop of the FIG. 1 embodiment. In FIG. 3, the swash pump 1 and the swash plate angle control piston and cylinder 3 and pressure compensator 5 have been designated similar reference numerals. However, instead of the control valve 17, there is in this embodiment provided a proportional control valve 26 having a spool 27 provided with 3 lands 28, 29 and 31, each end of the spool 26 being acted upon by a centering spring 30 and 30', respectively, with the centering spring 30' having a greater preload than the spring 30 and thus serving to bias the spool 27 to the left as seen in FIG. 3 of the drawings. A main control port 32 of the spool 26 is connected to the larger diameter end (area A) of the displacement cylinder 3 with the control ports 33 and 34 to either side of the main control port 32 being connected to tank and to the pump outlet line 13, respectively. The left-hand end of the spool 27 is connected to a pressure signal related to the speed of the pump 1 in a manner similar to the spool 18 of the valve 17 in the FIG. 1 embodiment. The right-hand end of the spool 27 is connected to tank. In addition, a flow sensor 35 is connected across the valve 26, the flow sensor being in the form of a spring-loaded poppet valve 36 operating in a cylinder 37, with the inlet connected to the outlet pressure of the pump on line 13. The outlet port 38 of the flow sensor 35 is connected to one end of the valve 26 to the left-hand side of the land 28 and acting on an area $a_F$, with the outlet pressure of the pump being connected to the other end of the spool to the right-hand side of the land 31 and also acting on an area $a_F$.

In normal operation of the embodiment of FIG. 3 of the drawings, the pressure compensator operates as described above in relation to the FIG. 1 embodiment without any interference from the override means by way of the valve 26 with the flow sensor 35 associated therewith. This is because, the area A of the swash plate angle control piston and cylinder 3 is connected to tank because the control port 32 is connected to the port 33 by virtue of the spool 27 of the valve 26 being urged to the right, as seen in FIG. 3 of the drawings, due to the pressure signal related to the speed of the pump being relatively high and thus overriding the action of the spring 30' and the flow feedback differential signal. However, if the rotational speed of the pump should fall, due to a decrease in speed of the prime mover 4, then the pressure signal on the left-hand end of the spool 27 is reduced and the differential pressure from the flow sensor 35 in conjunction with the effect of the spring 30', moves the spool 27 to the left as seen in FIG. 3, with the result of the control port 32 is connected to the port 34 so that the outlet pressure of the pump 1 is now connected to the area A of the swash plate angle control cylinder which thus extends the piston therefrom so as to act upon the swash plate 2 and reduce the angle $\theta$ thereof against the action of the spring 8. Thus, the overall action of the override means of the second embodiment of FIG. 3 is the same as that of the embodiment of FIG. 1.

Figure 4:
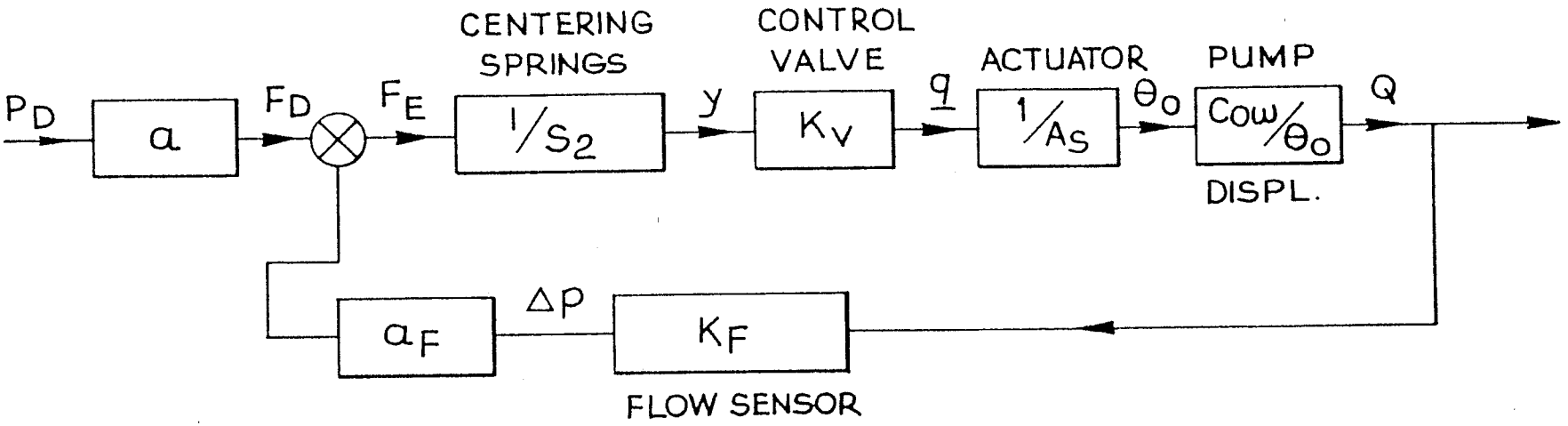
FIG. 4 is a block diagram representing the embodiment of FIG. 3.

FIG. 4 illustrates the embodiment of FIG. 3 in block form and this follows the block diagram of FIG. 2 of the first embodiment up to the flow q acting upon the area A of the displacement cylinder 3 giving rise to a change in swash plate angle $\theta$. However, this change in angle results in a pump displacement $C_O$ multiplied by the rotational speed w, divided by the swash plate angle $\theta_O$. This gives rise to a flow Q. This flow Q is applied to the flow sensor 35 represented as $K_F$ to produce a change in pressure $\Delta p$, this change of pressure being applied t the area $a_F$ of the valve 26 to provide the force $F_O$ applied to the summation device.

Figure 5:
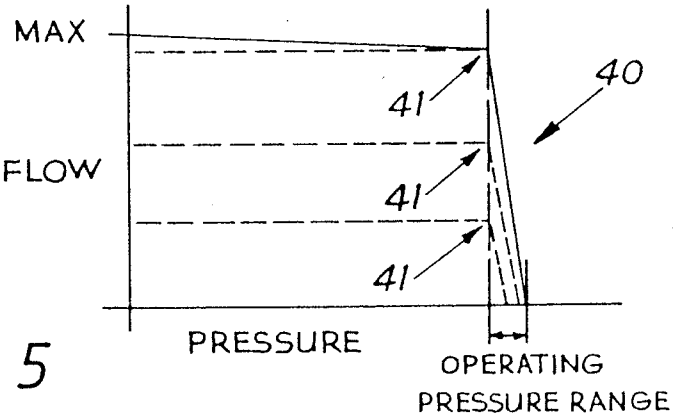
FIG. 5 is a graph useful in explaining the embodiments of FIGS. 1 and 3.

Turning now to FIG. 5 of the drawings, this is a plot of flow through the pump against the outlet pressure of the pump and the overall triangular portion indicated at 40 illustrates the characteristic of the pump in maintaining a substantially constant outlet pressure.

For industrial applications, pumps are normally driven by constant speed electric motors whereby the corner horsepower of the pump has to be matched to the effective power rating of the drive motor. For other applications, such as mobile and aerospace, the prime mover is often a variable speed device, whereby the available power is reduced as the speed decreases. If the corner horsepower of the pump is not adjusted to reflect the reduced drive power available, then a stall condition can occur. FIG. 5 shows three corner horsepowers 41 for different flow rates.

Figure 6:
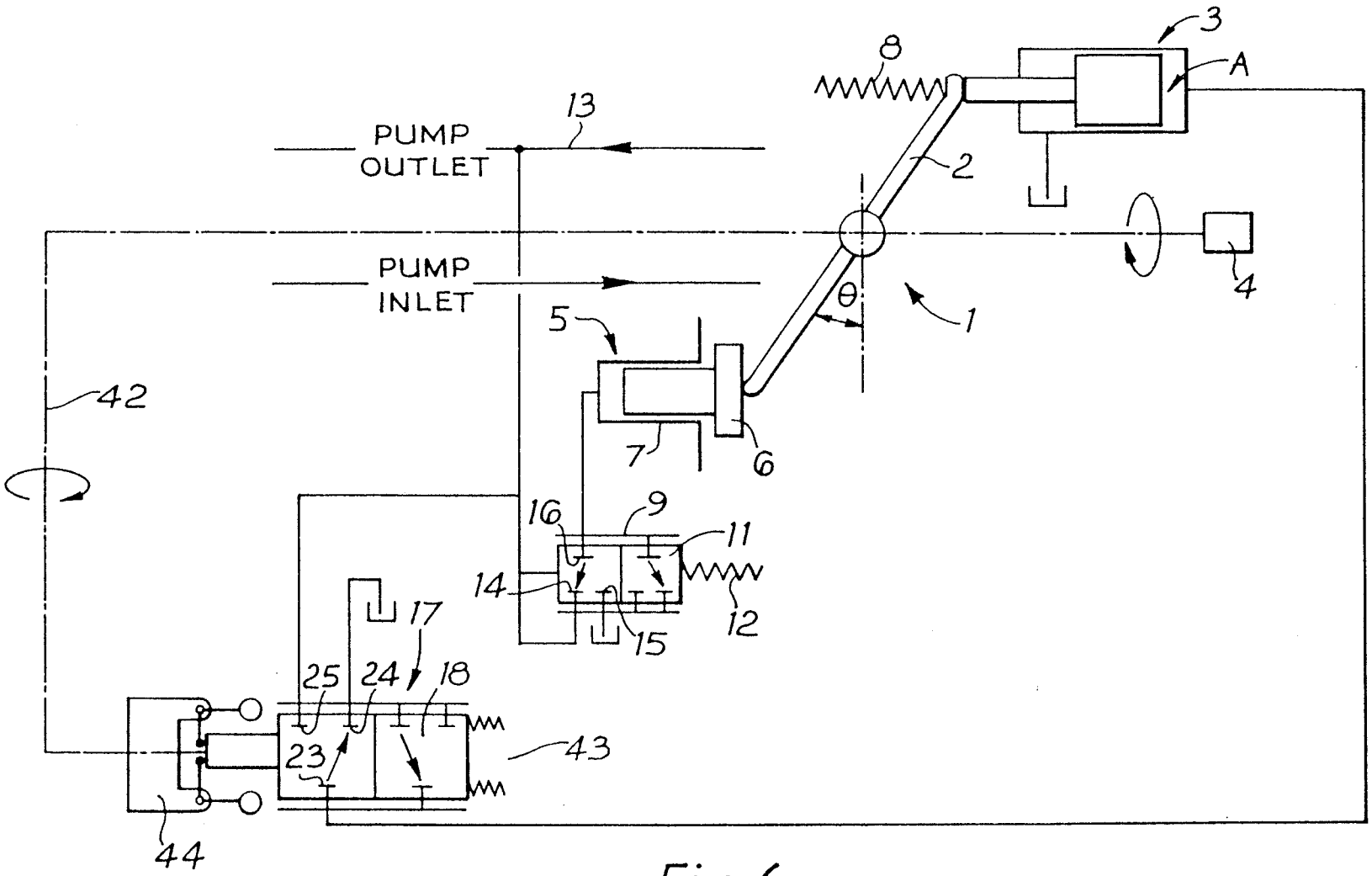
FIG. 6 is a schematic diagram of a preferred embodiment of the present invention.
Figure 7:
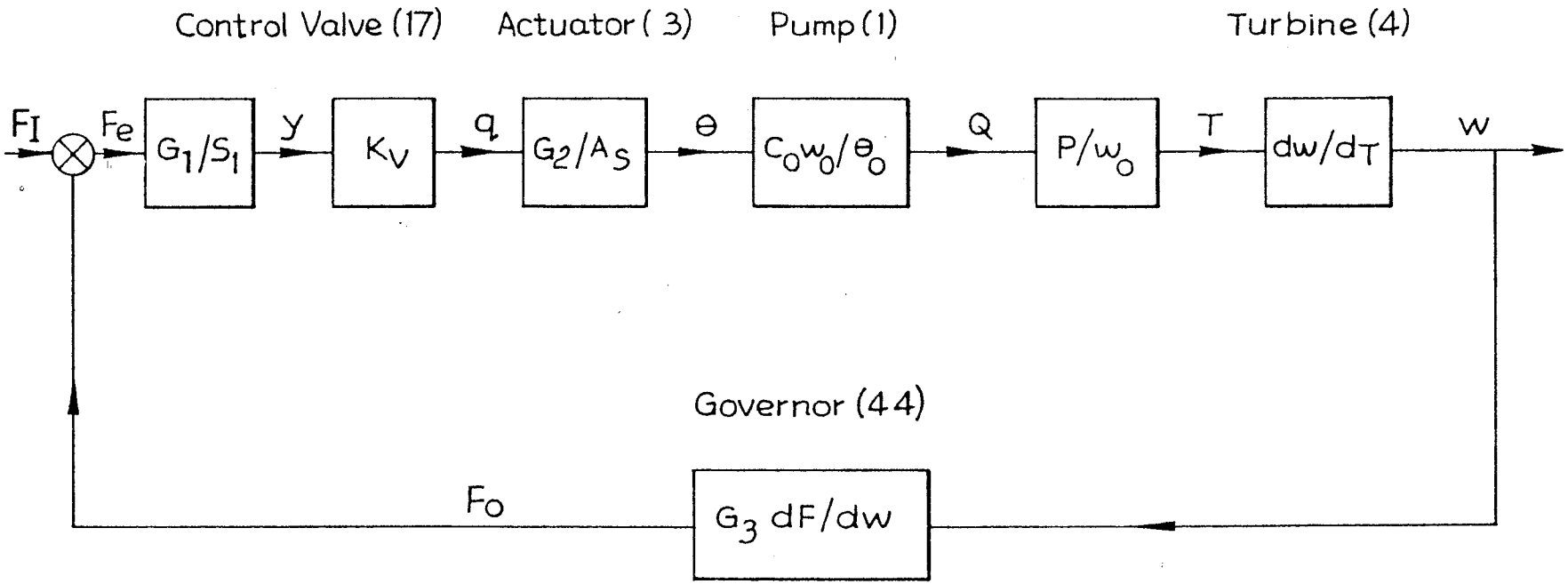
FIG. 7 is a block diagram representation of FIG. 6.

Turning now to FIGS. 6 and 7, these illustrate a preferred embodiment of the present invention which is basically similar to those illustrated in FIGS. 1 and 3 of the drawings in as much as the auxiliary hydraulic supply comprises a rotary, variable-displacement pump 1 having a swash plate 2 and a swash plate angle control piston and cylinder arrangement 3. The pump 1 is again driven by a ram air turbine 4.

A control valve 9 is employed, as with the other embodiments, in association with the pressure compensator 5. The override means in the form of a proportional control valve 17 is also employed, as with the previous embodiments, but in the embodiment of FIGS. 6 and 7, this is provided with a speed governor 44 and this represents the principal difference between the preferred embodiment and the embodiments of FIGS. 1 and 3. The speed governor 44 is of the centrifugal type (but other types may be employed) driven from the pump 1 and connected with one end of the spool 18 of the proportional control valve 17, the other end of the spool being acted upon by a compression spring 43. The spool 18 of the control valve 17 is provided with three ports the centre one 23 of which is blocked in the null position of the valve, this control port being connected to the actuator 3.

In normal and first regime of operation, the ram air turbine 4 rotates at a relatively high speed when the airspeed is above 171 KTS. Accordingly, the speed governor 44 will also be rotated at a relatively high speed such that the spool 18 is moved to the right, as seen in FIG. 6 of the drawings, against the action of the spring 43, thus connecting the control port 23 to tank 24 and hence connecting the actuator 3 to tank. Thus, as with the earlier described embodiments, the control valve 9 operates to control the position of the swash plate 2, via the actuator 5, in order to deliver the required output pressure from the pump 1. In this first regime of operation, a speed governor (not shown) associated with the turbine operates to maintain substantially constant the rotational speed of the ram air turbine 4, for example at 5250 rpm. This speed governor controls the pitch of the turbine blades.

Figure 8:
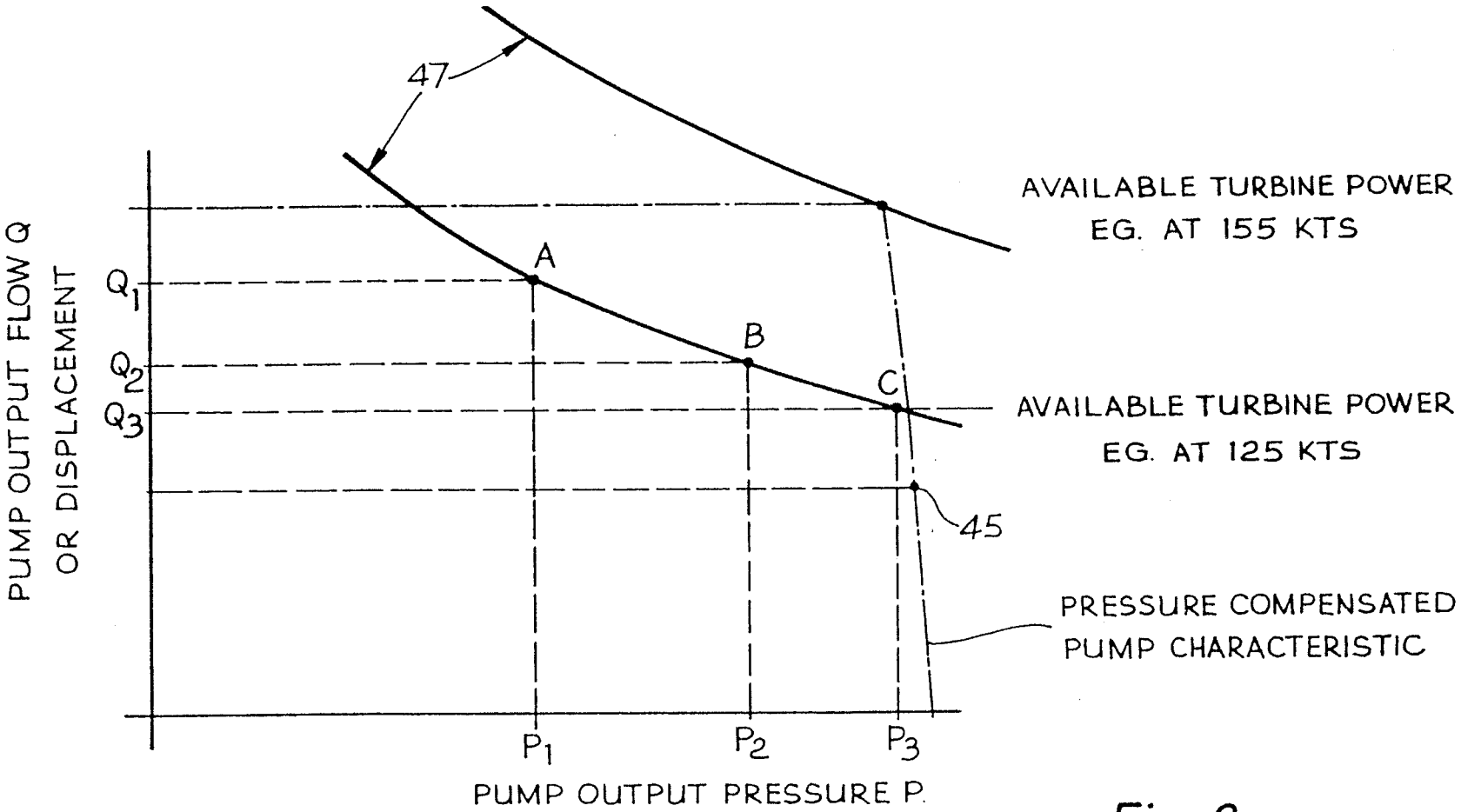
FIG. 8 is a graph useful in explaining the embodiment of FIGS. 6 and 7.

In a second regime of operation at air speeds between 155 and 171 KTS, the turbine speed governor is rendered inoperative and the turbine blades are at a constant pitch, referred to as "fine pitch" and the speed governor 44 associated with the control valve 17 is also inoperative in the sense that the turbine speed is still such as to maintain a connection between the control port 23 and tank. Thus, if the demand on the pump 1 increases, then the turbine speed drops with torque remaining substantially the same until the rotational speed of the turbine 4 drops to 3,800 rpm at which speed governor 44 becomes operative to maintain the rotational speed of the pump 1 at 3,800 rpm. This rotational speed is maintained by the governor 44, in a third regime of operation involving a range of air speeds of 125 and 155 KTS, by changing the displacement of the pump 1 to match available turbine power, i.e. operating along the curves 47 of FIG. 8. Referring to FIG. 8, if the demand on the pump 1 is relatively low, below the minimum for a given airspeed 45, then the pump will operate in the normal pressure-compensated mode but if flow demand increases, then the corner horse power (A, B, C for example, in FIG. 8) of the relevant curve of flow against pressure is reached and thereafter, the pump is operated in a constant power mode, whereby pump outlet pressure reduces as flow demand increases.

At 3,800 rpm, the swash plate 2 of the pump 1 is held at its instant position. If the pump thereafter operates in the pressure-compensated mode, then the pump will speed up and the pump governor 44 rendered inoperative. If, however, the pump is operating in the constant power mode, then the governor 44 is operative but pressure will vary with flow, as explained, the pressure increasing as flow decreases.

It will be appreciated that the three regimes of air speed discussed above can be varied as regards the air speeds concerned and also, the rotational speed at which the governor 44 is rendered operative can be arranged to be other than 3,800 rpm.

With the preferred embodiment of FIGS. 6 and 7, it will be seen that the provision of a speed control mechanism in association with the pump provides constant horse power cut-off characteristics to the otherwise pressure-compensated pump.

Referring now to FIG. 7, this shows in block diagram form the speed control loop of the embodiment of FIG. 6 with the single-acting, spring-loaded valve displacement control actuator 3 being controlled by the three-way proportional control valve 17 with which is associated the speed governor 44. The control valve 17 is subjected to two opposing forces, namely the centrifugal force $F_o$ generated by the speed governor 44, and a reference spring force $F_i$ corresponding, at the null position of the control valve 17, to the governed speed of 3,800 rpm or some other predetermined speed. Displacement of the pump 1 is increased by retracting the swash plate displacement actuator 3 and the throttling action of the control orifices of the valve 17 between control pressure and tank pressure. The pump 1 is destroked by extending the swash plate displacement actuator 3 due to the throttling action of the control orifices of the valve 9 between pump outlet and control pressure. Thus, during on-stroking, the valve 9 acts as a meter-out valve, and during de-stroking, the valve acts as a meter-in valve. Still referring to FIG. 7 of the drawings, the displacement of the valve 17 due to an error force $F_e$ is converted to control flow q which in turn controls pump displacement $\theta$ and hence flow Q. The required turbine power is affected by variations in flow Q, pressure P and hence torque T resulting in variations of turbine and pump speed which is sensed by the governor 44 and fed back to the control valve 17, thus completing the speed control loop.

It will be seen that the speed control loop is described by seven active elements, including three dynamic terms. The dynamic terms $G_1(s)$ and $G_3(s)$ are represented by second order transfer function relating to the control valve 17 and governor 44, respectively. The actuator control includes a free integrator and is therefor represented by a third order function $G_2(s)$. Since the turbine blade angle control is inoperative with the turbine blades set at fine pitch at air speeds below 171 KTS, the turbine is described in this mode by the gain constant dw/dT. The error force $F_e$ produces a displacement y due to the spring rating of the pump control valve 17 and this displacement produces the flow q due to the flow gain $K_V$ of the control valve 17. The flow q produces a pump angle displacement theta which in turn produces flow Q due to the displacement c and rotational speed w of the pump 1. The flow q produces a torque T from the turbine from the ratio of pump outlet pressure P and rotational speed w. Pump speed w is derived from the torque T and applied to the pump speed governor 44 which produces the centrifugal force $F_o$ which is algebraically summed with the reference spring force $F_i$ to produced error force $F_e$.

The embodiment of FIGS. 6 and 7 lends itself to programming as regards the governed speed of the pump 1, and this programming can be effected mechanically, hydraulically, electrically or a combination thereof. Essentially, the programming is achieved by varying the preload on the spool 18 of the control valve 17 This can be achieved by varying the spring 43 directly or via a solenoid, or motor, or motor driven screw, for example, or by applying hydraulic pressure to one end of the spool. Programming may be effected within the speed governor 44.

It will be seen that the present invention provides a simple, but highly effective, override means for a normal pressure-compensated variable displacement pump such as to maintain the integrity thereof at least within a predetermined operational range of a prime mover used to drive the pump. In the context of aerospace applications, the invention therefore provides a reliable alternative hydraulic power supply and furthermore, as regards the three illustrated embodiments, the override means are both of a hydro-mechanical nature so that it is not necessary to incur the expense of providing a duplicate, if not triplicate, system in order to provide redundancy of systems which is normally required by aviation authorities if electrical or electronic controls are employed. However, in circumstances where electrical or electronic control is required in aerospace situations, then the necessary redundancy can be built in and in different applications, electrical or electronic control, without redundancy, may be employed.

When a speed sensor or governor is employed in association with the pump, the following advantages are obtained:

a. The onset of pump constant speed control is well displaced from the turbine governed speed and should be far less interactive.

b. The constant speed control simplifies the pump control requirements considerably, eliminating the need for a derived constant power characteristic (straight line approximation).

c. The speed sensing arrangement need not of necessity be an integral part of the pump.

d. This closed loop control should provide an accurate constant power characteristic matched exactly to the turbine output capability, without recourse to complex pump controls.

e. Removal of complex controls will enhance reliability.

We claim:

1. An emergency hydraulic supply system comprising:

a) a source of hydraulic fluid, b) a rotary variable-displacement hydraulic pump coupled to said source and operable to supply hydraulic fluid under pressure, c) a rotary prime mover coupled to said pump and operable to drive the same, d) pressure-compensated control means coupled to said pump and operable alone, in a first regime of operation of the system, to vary the displacement of said pump, said first regime of operation corresponding to a first rotational speed of said prime mover, and e) a speed control loop comprising said control means, said pump and said prime mover, and additionally comprising:

i. combined speed sensor and speed governor means operable to provide a signal representative of the rotational speed of said prime mover, ii. override means coupled to receive said signal and arranged to be inoperable during said first regime of operation and arranged to be rendered operative to override said control means during a second regime of operation of the system corresponding to a second rotational speed of said prime mover, said second rotational speed being lower than said first rotational speed, whereby said pump is maintained at a substantially constant speed during said second regime with the override means varying the displacement of said pump to match available prime mover power.

2. A pump according to claim 1, wherein the signal related to the rotational speed of the pump is a hydraulic pressure signal.

3. A pump according to claim 1, wherein the signal related to the rotational speed of the pump is an electrical signal.

4. A pump according to claim 1, wherein means are provided for adjusting the minimum speed of the pump.

5. A system according to claim 1, and further including speed governor means coupled to the prime mover, said speed governor being operable during said first regime to govern the speed of said prime mover and being rendered inoperative during said second regime.

6. A system according to claim 1, wherein the system has a third regime of operation corresponding to a third rotational speed of said prime mover, said third rotational speed being intermediate said first and second rotational speeds, said combined speed governor and speed sensor means and said prime mover speed governor both being inoperative in said third regime, whereby if the demand on said pump increases during said third regime, the speed of the prime mover decreases, with torque remaining substantially constant.

7. A pump according to claim 1, wherein the prime mover is a ram air turbine.

8. A pump according to claim 7, wherein the ram air turbine is provided with a speed governor.

9. A pump according to claim 1, wherein the override means are in the form of a control valve responsive to the signal related to the rotational speed of the pump and operable to apply pump outlet pressure to the displacement means of the pump to de-stroke the pump when the rotational speed of the pump decreases.

10. A pump according to claim 9 and being in the form of a swash pump, the control valve being operable to apply pump outlet pressure to the displacement of the swash pump to de-stroke the pump when the rotational speed of the pump decreases.

11. A pump according to claim 9, wherein the control valve is responsive to the output flow of hydraulic fluid from the pump.

12. A pump according to claim 11, wherein the control valve has a flow sensor connected across the spool thereof.

13. A system according to claim 1, and further including means for programming the governed speed of said pump.

14. A pump according to claim 13, wherein the signal related to the rotational speed of the pump is an electrical signal.

15. A pump according to claim 13, wherein the signal related to the rotational speed of the pump is a hydraulic pressure signal.

16. A pump according to claim 13, wherein means are provided for adjusting the minimum speed of the pump.

17. A system according to claim 13, wherein said programme means are associated with said combined speed sensor and speed governor means.

18. A system according to claim 13 wherein said programme means are associated with said override means and said override means comprise a proportional control hydraulic valve having a housing, a spool slidably mounted in the housing and a return spring acting between said housing and one end of said spool, said programme means being operable to vary the preload of said return spring.

19. A system according to claim 18, wherein said programme means varies said return spring directly.

20. A system according to claim 18, wherein aid programme means varies said return spring indirectly via drive means.

21. A system according to claim 20, wherein said drive means is selected from a solenoid, a motor, motor-driven screw, and hydraulic pressure.

22. A pump according to claim 13, wherein the override means are in the form of a control valve responsive to the signal related to the rotational speed of the pump and operable to apply pump outlet pressure to the displacement means of the pump to de-stroke the pump when the rotational speed of the pump decreases.

23. A pump according to claim 22 and being in the form of a swash pump, the control valve being operable to apply pump outlet pressure to the displacement of the swash pump to de-stroke the pump when the rotational speed of the pump decreases.

24. A pump according to claim 22, wherein the control valve is responsive to the output flow of hydraulic fluid from the pump.

25. A pump according to claim 24, wherein the control valve has a flow sensor connected across the spool thereof.

26. In an aircraft, an emergency hydraulic supply system comprising:

a) a source of hydraulic fluid, b) a rotary variable-displacement hydraulic pump coupled to said source and operable to supply hydraulic fluid under pressure, c) a prime mover in the form of a ram air turbine coupled to said pump and operable to drive the same, d) pressure-compensated control means coupled to said pump and operable alone, in a first regime of operation of the system, to vary the displacement of said pump, said first regime of operation corresponding to a first rotational speed of said ram air turbine, and e) a speed control loop comprising said control means, said pump and said ram air turbine, and additionally comprising:

i. combined speed sensor and speed governor means operable to provide a signal representative of the rotational speed of said ram air turbine, ii. override means coupled to receive said signal arranged to be inoperable during said first regime of operation and arranged to be rendered operative to override said control means during a second regime of operation of the system corresponding to a second rotational speed of said ram air turbine, said second rotational speed being lower than said first rotational speed, whereby said pump is maintained at a substantially constant speed during said second regime with the override means varying the displacement of said pump to match available power from the ram air turbine.

27. A system according to claim 26, and further including speed governor means coupled to the arm air turbine, said speed governor being operable during said first regime to govern the speed of said ram air turbine band being rendered inoperative during said second regime.

28. A system according to claim 26, wherein the system has a third regime of operation corresponding to a third rotational speed of said ram air turbine, said third rotational speed being intermediate said first and second rotational speeds, said combined speed governor and speed sensor means and said ram air turbine speed governor both being inoperative in said third regime, whereby the ram air turbine is a constant pitch and if the demand on said pump increases during said third regime, the speed of the prime mover decreases, with torque remaining substantially constant.

29. A system according to claim 26, and further including means for programming the governed speed of said pump.

30. A system according to claim 29 wherein said programme means are associated with said override means and said override means comprise a proportional control hydraulic valve having a housing, a spool slidably mounted in the housing and a return spring acting between said housing and one end of said spool, said programme means being operable to vary the preload of said return spring.

31. A system according to claim 29, wherein said programme means varies said return spring directly.

32. A system according to claim 29, wherein aid programme means varies said return spring indirectly via drive means.

33. A system according to claim 29, wherein said drive means is selected from a solenoid, a motor, motor-driven screw, and hydraulic pressure.

34. A system according to claim 29, wherein said programme means are associated with said combined speed sensor and speed governor means.

* * * * *